United States Patent [19]

Ellison

[11] 3,975,843

[45] Aug. 24, 1976

[54] PORTABLE POWER DIGGING TOOL

[76] Inventor: Wallace D. Ellison, 3116 Glendon Ave., W. Los Angeles, Calif. 90034

[22] Filed: July 15, 1974

[21] Appl. No.: 488,400

[52] U.S. Cl. ..... 37/86; 37/191 A; 37/DIG. 2; 192/12 BA; 280/255

[51] Int. Cl.[2] ..... E02F 3/08

[58] Field of Search ..... 280/253, 255, 258, 244, 280/220, 221; 37/DIG. 2, 86, 83, 191 R, 191 A, 192 R, 192 A; 192/12 BA

[56] References Cited

UNITED STATES PATENTS

| | | | |
|---|---|---|---|
| 1,760,964 | 6/1930 | Ruth | 37/DIG. 2 |
| 1,764,949 | 6/1930 | George | 37/DIG. 2 |
| 2,723,131 | 11/1955 | McChesney, Jr. | 280/221 |
| 2,890,532 | 6/1959 | Ellison | 37/86 |
| 2,990,631 | 7/1961 | Brown | 37/86 |
| 2,997,276 | 8/1961 | Davis | 37/86 X |
| 3,051,445 | 8/1962 | Moulton | 192/12 BA X |
| 3,430,982 | 3/1969 | Despain et al. | 280/255 |

*Primary Examiner*—Clifford D. Crowder

[57] ABSTRACT

A power spade which is hand operated by one man and does the work of a common pick and shovel is disclosed. The power spade is designed to operate in confined and restricted areas where larger wheeled or track-conveyor power shovels, ditch diggers, trenches, etc., cannot operate. The invention comprises a portable one-man operated shovel type digger which has an upright frame supporting an endless chain that has a number of buckets attached thereto. A small electric or gasoline motor is coupled to the frame and drives the endless chain on which the buckets are disposed. An operator holds the frame in position by grasping the handle and by bracing with one foot a lever stirrup assembly. Direction of the digging is controlled by the operator tilting the frame and pushing or pulling on the bracing lever with his foot. The buckets have formed sidewalls which are rigidly attached to a chain and bottoms which are pivotally mounted on the chain, and capable of engaging a cam, thereby ejecting soil contained therein.

4 Claims, 17 Drawing Figures

PORTABLE POWER DIGGING TOOL

A disclosure of this application was filed with the U.S. Patent Office under the disclosure program, 019510, filed May 25, 1973.

BACKGROUND OF THE INVENTION

1. Field of the Invention

This invention relates to improvements for a power spade and particularly to a portable power spade which is adapted to be operated by a single operator.

2. Prior Art

Many mechanical and power tools have been developed for the construction industry. However, most power tools are designed for large scale uses and are not adapted to be utilized on hand power tool job which require only one man. Because todays labor costs are high, methods need to be devised to enable laborers to perform more work in the same amount of time. Regardless of the amount of developed power equipment available on the market today, many jobs still require individual one-man care. This is especially true in many jobs requiring the use of pick and shovels.

Very few tools have been developed which mechanically perform the task that are required by a single man utilizing a pick and a shovel. One example of such a device is my invention which was issued U.S. Pat. No. 2,890,532. This invention discloses a portable one-man operated shovel having an upright frame and supporting an endless conveyor which has a number of buckets disposed thereon. A small engine is attached to the frame and drives the conveyor.

Although the basic concept of my previous invention performed adequately as a manual power digger, several problems resulted from its construction. The buckets disclosed therein are solid trapezoidal shaped buckets which are pivoted on a cam and dump the dirt therefrom by tilting to one side. These buckets are mounted to a wire formed chain which rotates about specially made sprockets. When either the buckets or the chain need to be replaced or repaired special parts are required. In addition, the solid shaped buckets which tilt to empty the soil also serve as cutting instruments, and sometimes become damaged in digging such that they will not properly rotate about their axis and empty of the dirt contained therein. Another problem arose in the stirrup and lever assembly because of the difficulty of moving the power spade when digging a ditch or trench.

The present invention solves these problems involved in the prior art and provides improvements which enable a manual power spade to be properly used for digging in restricted areas, for digging trenches, post holes and other types of excavations. Besides solving the problems of the prior art, the present invention provides several new features which make the power digger more desirable.

SUMMARY OF THE INVENTION

A portable one-man operated shovel type digger which has an upright frame supporting an endless chain that has a plurality of buckets disposed thereon. A small electric or gasoline motor attached to the frame drives the chain while the lower end of the conveyor performs the digging. A lever stirrup assembly holds the frame in position while the operator tilts the frame by a handle that is attached to the frame. A unique cam assembly, is disposed on the frame which engages the bottom of each bucket and ejects the soil therefrom. In addition, each bucket is arranged to be fastened directly to the endless chain. The digger is supported during digging operations by the handle and lever and stirrup assembly which creates a moment in the lever tending to lift upward on the outer end of the lever. This moment relieves the operator of the necessity of supplying a force to counter a part of heavy digging and dead weight loads of the digger thereby enabling the operator to manipulate the handles fore and aft up and down and thereby guide the digger while the motor, buckets, and chains perform a majority of the work.

An object of the invention is to provide a practical, portable digger which is reliant on the operation of an engine for the principal motive force to achieve the digging operation, the digger featuring ease of operation and manueverability as well as dependability.

Another object of the present invention is to provide solid pre-formed cutting buckets which have a hinged bottom which ejects the soil contained therein. The formed buckets being mounted directly to a standard double link chain which is easily replaced or repaired.

Another object of the invention is to provide a fail-safe switch which turns the machine off when pressure is released from a switch disposed on the frame handle.

Still another object of the present invention is to provide a spiked ratchet capable of being disposed on the bracing lever which may be used for positioning the power spade either forward or backward during the digging operation.

DETAILED DESCRIPTION OF THE PREFERRED EMBODIMENT

Figures 1, 2, 3, 4, 5, 6, 7:
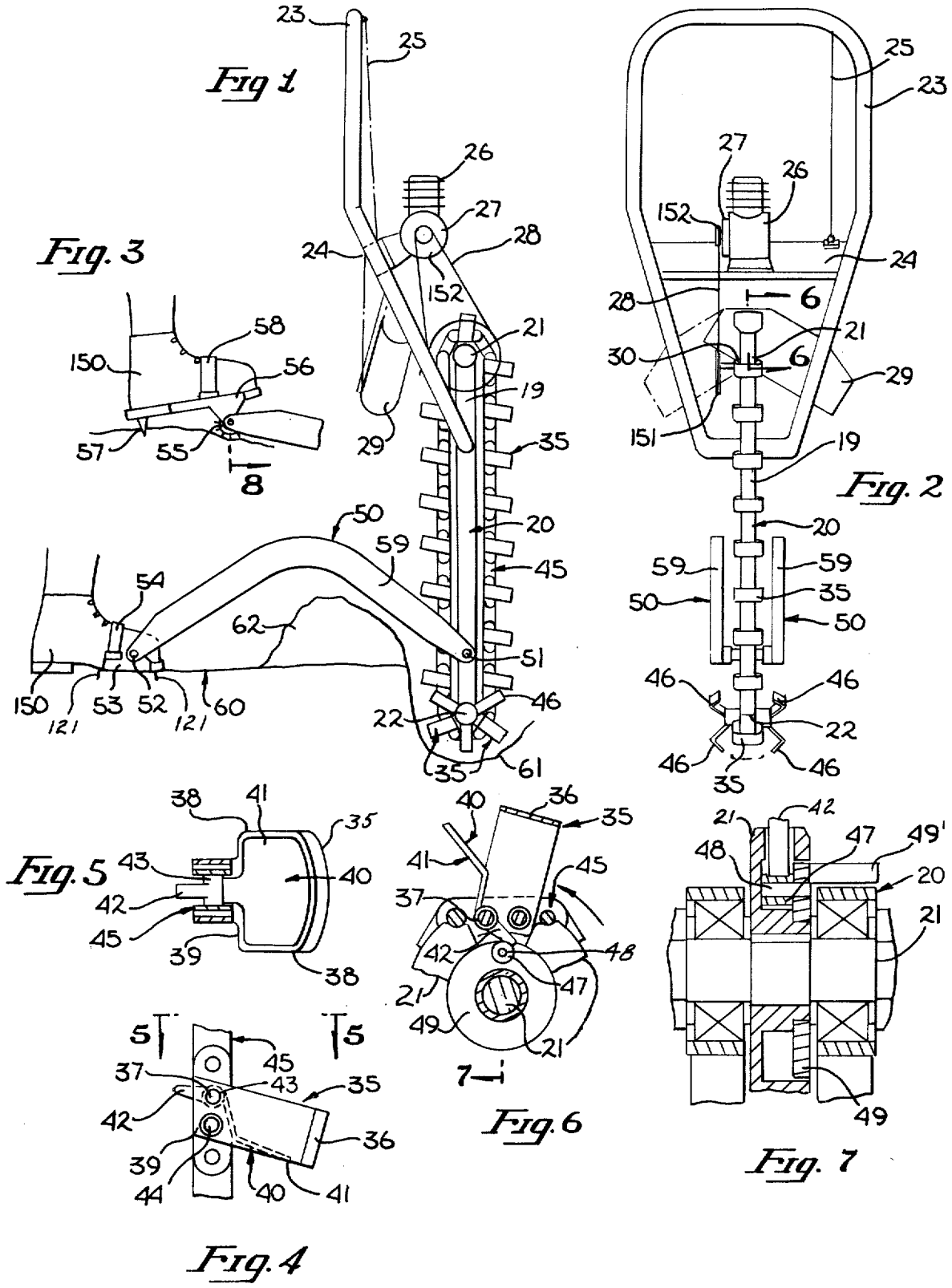
FIG. 1 is a side view of the power spade of the present invention, shown excavating a post hole.
FIG. 2 is a front view of the power spade of FIG. 1.
FIG. 3 is a partial side view of the power spade of FIG. 1, with a spiked sprocket attached to the foot pad.
FIG. 4 is a side view of a digging and carrying bucket coupled to the chain of the power spade of FIG. 1.
FIG. 5 is a sectional view of the digging and carrying bucket of FIG. 5 taken along line 5—5 of FIG. 4.
FIG. 6 is a partial sectional view of the upper sprocket of the power spade taken along line 6—6 of FIG. 2.
FIG. 7 is a sectional view of the upper sprocket along line 7 of FIG. 6.

Now referring to FIG. 1, the power spade of the present invention is shown. The main frame 20 of the present invention is comprised of an elongated or square member 19, having an upper shaft and sprocket 21 and a lower shaft sprocket 22. The handle 23 is formed from a tubular member, in the presently preferred embodiment, and is bent in a generally tear drop shape such that one end thereof is secured to one side of the elongated frame 19 while the other end is secured to the opposite side of the elongated frame. The ends are secured to the frame by welding or other known means for fastening near the upper end as shown in FIGS. 1 and 2. As illustrated in FIG. 1, the handle 23 is inclined backwards so as to not be in axial alingment with the axis of the elongated member. The handle 23 extends upwardly from the top of the elongated frame 19, a distance equal to approximately one half of the length of the main frame and permits an operator to slide his grasp up and down the handle during operation of the power spade and provide lateral stability during operation. In the present embodiment, the handle is shown as a tubular jointless member, however in an alternate form, the handle may be jointed so as to fold, thereby providing for ease of storage and transportation.

A bracing lever assembly 50 is pivotally attached to member 19 about point 51. A pair of angular members 59 extend from the pivot point 51 on the frame 50. The angular members are formed in a generally obtuse angle as shown in FIG. 1. The free end of the angular members 59 are pivotally mounted on shaft 52 which is pivotally mounted to foot pad 53 as shown in FIG. 1. The bracing lever 50 and cleats 121 held to the ground by the operator inserting a foot 150 onto the foot pad and by being secured thereto by strap 54. In this manner, the operator can provide horizontal stability at ground level to the power spade. The assembly essentially functions to transmit the kick loads from digging back into the ground, thereby lessening the amount of force required by the operator to exert on the handle while providing a controllable power spade. The foot pad and bracing assembly is described in more detail hereinafter however, it is used for bearing against the ground thereby providing horizontal stability at ground level. The angular members 59 of the assembly are shaped generally in an obtuse angle projecting first upward and then an equal amount downward and are pivotally mounted to the main frame such that the forward section of the assembly can follow the main frame into the hole as the digger lowers itself by excavating dirt therefrom. The stirrup assembly as shown in FIG. 1, is comprised of an adjustable strap 54 a foot pad 53, and cleats 121 however the preferred form is shown in FIG. 3 and is comprised of a foot plate 56 having cleats 57 for increasing friction between the ground 60 and the foot pad. The foot pad is mounted on cleated spool 55 and an adjustable strap 58 is used to secure various size shoes thereto. The cleated spool 55 and foot plate are rotatably mounted such that an operator may lift and lower his heel to propell the power spade to either work forward or backward.

Figures 8, 9, 10, 11, 12, 13, 14, 15, 16, 17:
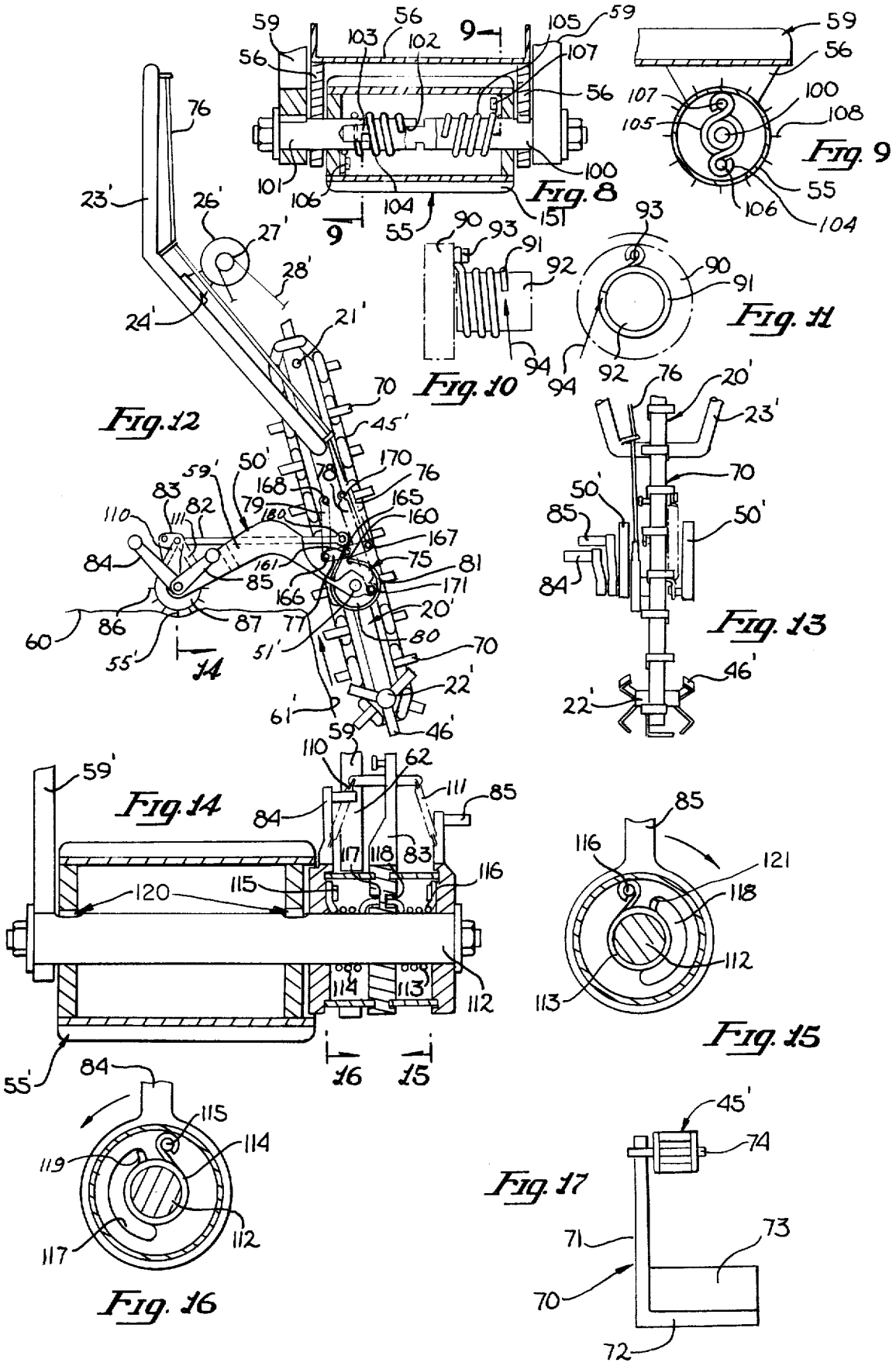
FIG. 8 is a sectional view taken along line 8 of FIG. 3.
FIG. 9 is a sectional view of the spiked sprocket of FIG. 8, taken along line 9—9 of FIG. 8.
FIG. 10 is a side view of a device illustrating the single coil spring clutch release principle.
FIG. 11 is a front view of the device illustrated in FIG. 10.
FIG. 12 is a side view of the second preferred embodiment of the power spade of the present invention.
FIG. 13 is a partial front view of the power spade of FIG. 12.
FIG. 14 is a blown-up cross sectional view of the foot levers taken along line 14 of FIG. 12.
FIG. 15 is a cross sectional view taken along line 15 of FIG. 14.
FIG. 16 is a cross sectional view taken along line 15 of FIG. 14.
FIG. 17 is a top view of the dragging buckets of the power spade of FIG. 12.

This single coil spring clutch release principal can be used as shown in FIG. 8, to alternately lock foot pad 56 in relation to cleated spool 55 and/or permit cleated spool 55 to rotate as the foot pad 56 is rotated. The composite shaft of the cleated spool 55 is formed from shafts 100 and 101. Shaft 101 has a co-axial bore 102 into which end 103 is inserted and is freely able to rotate. Shaft 101 is locked in relation to the bracing lever 59 while shaft 100 is secured to foot pad 56 and rotates with foot pad 56. Cleated spool 55 rotates freely on shafts 100 and 101 but is fastened to each end of coil springs 104 and 105. Coil spring 105, which is left hand wound and mounted around shaft 100 and secured to housing 151 of the cleated spool 55 by screw 107. Coil spring 104 is right hand wound and mounted around shaft 101 and secured to housing 151 by screw 106. FIG. 9 shows coil spring 104 and 105 in partial section around the shafts.

The operation of the cleated sprocket 55 when assembled as described above, is now described in reference to FIG. 8. The operator can propel the power spade in one direction by placing his foot on the foot pad 56 and lifting his heel up and down. Specifically, when the heel of the operator is brought down, the foot pad 56 causes shaft 100 to rotate therewith. Clutch spring 105 grips shaft 100 and causes cleated spool 55 to rotate such that the cleats 88 will dig into the ground and pull the power spade backwards at the same time clutch spring 104 is released to rotate on shaft 101 by the unwinding action of spring 104. When the heel of the operator is lifted spring 104 grips stationary shaft 101 preventing cleated pool 55 it from rotating back as spring 105 releases shaft 100. By repeating the cycle of the operator lifting and dropping his heel, the power spade can be caused to work backwards at any pace desired by the operator. By interchanging right and left hand springs 104 and 105, operation of the cleated sprocket 55 will cause the power spade to work away from the operator.

The handle 23 has a structual bar 24 secured thereto which extends between two opposite sides of the handle slightly above the upper end of the main frame 20 as best shown in FIG. 2. The bar 24 may be welded to the handle or be formed as part thereof. A motor 26 coupled to a clutch assembly 27 is mounted on the structural bar 24 to provide power to drive the power spade. The motor 26 in the presently preferred embodiment is a small gas internal combustion engine, however in an alternate embodiment an electrical three quarter horse power motor may be employed. The motor 26 can be activated by applying pressure to cable 25 by grasping it with the hand. Cable 25 serves as an automatic switch and is coupled electrically to the motor. Cable 25 is disposed between the upper portion of handle 23 and and structural member 24 as shown in FIG. 2 and is spring loaded so as to be in the off position. If for any reason pressure is released from the cable, the spring will cause it to return to the original position turning the engine 23 off. In normal usage the operator grasps both sides of the handle 23 and when ready to begin excavating pulls the cable towards the handle thereby activating the motor. At any time thereafter when the cable is released, the engine will automatically turn off.

The motor 26 is coupled to a typical slip clutch assembly 27 of the type well known in the art. In an alternate embodiment, a conventional direct drive clutch assembly could be employed alternately the motor can be coupled directly to a driving sprocket. However, in the presently preferred embodiment, a slip clutch is employed to provide increased safety for both the operator and power spade. In normal digging operation when a rock or other solid object is hit the clutch will slip while the motor continues to run and thereby not damage the power spade. A sprocket 152 is coupled to the clutch 27 for driving chain 28, however, in an alternate embodiment a "V" belt and pully may be used to supply power to the digging portion of the power spade.

The upper and lower bucket sprocket 21 and 22 respectively are rotatably mounted to the upper and lower ends of the elongated main frame 19 shown generally in FIGS. 1 and in detail in FIG. 6. A large sprocket 151 is coupled to the same shaft as the upper shaft and sprocket 21 so as to rotate with the upper shaft and sprocket 21. Large sprocket 151 engages chain 28 and drives the upper sprocket 21. In the presently preferred embodiment, both the upper and lower sprockets 21 and 22 of the main frame 19 are capable of engaging a standard double link chain 45 of the type well known in the art. Thus, power is supplied to chain 45 which rotates about the upper and lower sprocket. The chain 45 is positioned as shown in FIG. 1 so as to form an enclosed loop about the main frame 19. In the preferred form, the chain is driven in a counter clockwise direction, however it could be driven as well in a clockwise direction.

A plurality of buckets 35 are formed and disposed on the double link chain 45 and serve as the excavating tools. The buckets 35 are shown mounted on the chain 45 in FIG. 1 and are described in detail in reference to FIGS. 4, 5 and 6. The buckets 35 perform a dual function since they both cut and transport soil. The sidewalls of the buckets 35 are generally 'U' shaped having a front 36 generally perpendicular to oppositely disposed sides. The sides 38 taper at the rear so as to form a neck 39 slightly wider than the chain 45. The side walls are formed from a rigid durable metal, such as steel, since they are used to cut into the soil as well as transport it. The 'U' shaped sidewall is fastened to the chain 45 by bolting in the preferred form, FIG. 4, however, other methods for securing the sidewall to the chain may be employed. The bottom 40 of the bucket 35 is a separate member and is generally shaped like a spoon and formed from a rigid material such as steel. The spoon end 41 is shaped so as to be able to be passed through the sidewalls of the bucket while the finger 42 passes through the chain protruding as shown in FIG. 5. The bucket bottom is rotatably mounted on bushing 43, bushing 43 is disposed on pin 37 which is secured between the links of chain 45 as illustrated in FIGS. 4 and 5. The finger portion 42 projects from behind chain 45 and is capable of engaging cam roller 47 which is disposed on the adjusting bracket 49 by pin 48. Adjusting bracket 49 is shaped like a washer and fits into a circular slot of sprocket 21. Cam roller 47 on pin 48 protrudes into a cylindrical slot on the inside of sprocket 21. Bracket 49 is normally stationary except when adjusting and floats inside the slot of sprocket 21, FIG. 7.

The cam finger 42 is best illustrated in FIGS. 6 and 7. In FIG. 6 the finger 42 of the bottom 40 of the bucket 35 is shown engaging the cam roller 47 and causing the bottom 40 of the bucket 35 to rotate about pin 37 such that the soil contained therein is ejected from the bucket. In use the chain 45 revolves around the upper and lower sprocket. When a bucket 35 is near the bottom sprocket 22 soil is scooped therein and as it moves and approaches the upper sprocket 21 the finger portion 42 of the bottom of the bucket reaches through chain 45 and through a hole in sprocket 21 into a circular slot inside sprocket 21 engages the cam roller. As the bucket passes over the upper sprocket, FIG. 6, the bottom 41 of the bucket is forced to pass through the sidewalls and forcefully eject the soil contained therein, and as the bucket passes over the upper sprocket the bottom moves back into its original position as shown in FIG. 4. The cam roller 47 is located on the pin 48 of the bracket 49 and is generally cylinderical in shape. The cam roller 47 is secured to adjustable mounting bracket 49 (FIG. 7) and is capable of being moved and again fastened to frame 20 at tab 49, so as to change the point of engagement of the roller and cam finger of the bottom of the bucket. The engagement is critical in that it determines the position at which the soil will be ejected therefrom. The adjusting bracket 49 is held in position by a set screw (not shown) which provides for ease of adjustment.

When the proper engagement point is set, engagement of the cam finger 42 of the bucket 35 and cam roller will cause the soil to be forcefully ejected from the bucket into chute 29. Chute 29 is movably mounted to the structural member 24 and capable of receiving soil ejected from the buckets and falls to either side of the excavation. The chute 29 is mounted on trunion points 30 so as to be able to be rotated from side to side for disposing of the excavated soil on either side of the excavation. Chute 29 is generally semi-cylinderical in shape and hand positionable.

Side cutters 46 are rotably secured to the bottom shaft and sprocket 22 so as to rotate as the chain 45 drives the sprocket. The side cutters are angular shaped to enable the power spade to cut an excavation slightly wider than the width of the frame 50 as well as to move soil from the edges of the hole 61 to the center, in order that buckets 35 may pick up the loosened soil. The side cutters 46 have sharp edges and are of special value for cutting roots, hard clay or any other rugged material. The side cutters 46 are generally angular shaped prongs (FIG. 2) and are disposed on each side of the lower sprocket. In the presently preferred embodiment three prongs are used on each side thereof. In an alternate embodiment a ring or hoop (not shown) may be employed and serve to support the power spade as it is used. For example, if the spacing is sufficiently great and only three side cutters are employed, the spade will have a tendency to "buck" or bounce up and down as the buckets and cutters pass over the bottom of the sprocket 22. If however, the ring is added, the power spade will not "buck" but will tend to be continuously supported by the rings and side cutters, however the side cutters also provide increased efficiency in excavation. The side cutters provide an additional advantage in that they provide a shadow cut so as to allow bracing lever 59 which straddles the buckets and chain to follow the main frame 19 into the excavated hole 61.

Having now described the physical components of the presently preferred embodiment, their operation and function will be described. The power spade is activated by an operator grasping the handles 23 and by placing his foot into the stirrup 58, and forcing the base plate 56 against the ground 60 as shown in FIGS. 1 and 3. The motor 26 is activated by grasping cable 25 which causes pully 152 to rotate thereby driving belt 28 and upper sprocket 21 and the buckets 35 rotate counterclock wise around the main frame on chain 45. As the chain 45 rotates the bottom sprocket 22 and side cutters 46 begin rotating, cutting and loosening the soil.

The buckets in turn pass over the bottom sprocket and scoop up loosened soil and carry it upward. As each bucket approaches the top of the upper sprocket 21, the finger 42 of the bottom of the bucket engages the cam roller 47. When bucket reaches the top of the sprocket soil is ejected therefrom into the chute 29 falling on one side of the excavation. As the power spade continues to operate, it gradually works itself downward. The bracing lever 50 rotates about point 51 and follows the spade into the excavation. In this manner, the power spade may be used to dig vertical post holes. The power spade may also be used to dig trenches by having the operator dig a hole as previously described while tilting it backward and pushing or pulling the bracing lever with his foot. Thus, by a series of progressive steps, a trench may be excavated.

DETAILED DESCRIPTION OF THE SECOND PREFERRED EMBODIMENT

Now referring to FIGS. 10 through 17, the second preferred embodiment of the invention is disclosed. Like numerals are used to label like components of the second and preferred embodiments. The second embodiment of the invention includes the same basic elements as the preferred embodiment, however, several unique additional features are employed. Container buckets 35 of the first embodiment are eliminated and drag buckets 70 are provided such that the soil can be excavated from the hole or trench by simply being drug upward and permitted to fall to either side of the excavation 61'. The cam roller 47 of the preferred embodiment is not required since the drag buckets 70 are formed from a single structural member and are only used to cut and drag dirt rather than carry it and eject it into a dirt chute. An additional feature of the second preferred embodiment is that a locking brake 75 is provided to adjustably lock the bracing lever 50' into position during operation. Another feature is cleated spool 55' provided at the end of the bracing lever 50' which is rotated counter clockwise by lever 84 and clockwise by lever 85 the bracing lever and power spade can be moved either forward or backward. This system is described in detail hereinafter.

The cleated spool of the present invention utilizes a unique dual coil spring clutch release mechanism to permit the cleated spool to be rotated and held in position.

A single coil spring clutch release will now be descirbed in reference to FIGS. 10 and 11 to understand the dual coil clutch release spring mechanism. Member 90 is rotably mounted to shaft 92, coil spring 91 is secured to member 90 by screw 93 and coiled about shaft 92. Referring to FIG. 11, member 90 is prevented from rotating about shaft 92 in the clockwise direction since a slight rotation causes an increased tightening of the coil spring about the shaft and thereby increases the tension and locking therebetween. However, member 90 may be freely rotated in a counter clockwise direction since the spring will tend to unwind and lessen the friction therebetween. It is possible to rotate member 90 clockwise by applying a force 94 to the free end of spring 91 thereby reducing the fictional contact by uncoiling the spring and permitting member 90 to release and rotate. Member 90 can continue to be rotated clockwise until force 94 is withdrawn at which point member 90 again becomes locked in position against clockwise rotation. Member 90 and shaft 92 then rotate together as a unit.

The cleated spool 55', FIG. 14, is rotatably mounted to shaft 112 and transmits the kick loads back into the ground. In this embodiment, the cleated spool 55' is propelled by a pair of levers 84 and 85. Levers 84 and 85 drive shaft 112 which is keyed 120 to cleated spool 55', thereby driving the spool. The levers 84 and 85 employ the dual coil spring clutch release principle similar to the single coil spring release previously described. The cleated spool 55' is propelled by an operator depressing either of the levers 84 and 85. In this embodiment, lever 84 causes the power spade to move toward the operator while lever 85 forces the power spade away from the operator.

Referring to FIGS. 14, 15 and 16 the power driving mechanism of the cleated spool will be described. Shaft 112 rotates freely in relation to foot lever 84. Foot lever 84 is positioned about the cleated spool 55' and cleated spool 55'. Spring 110 is mounted between the support arm 83 and foot lever 84 so as to cause foot lever 84 to return to its original position as shown in FIG. 12. Right hand wound coil clutch spring 114 FIG. 16 is disposed around shaft 112 and secured by screw 115 to foot lever 84. The opposite end of coil clutch spring 114 is bent so as to project in a direction parallel to shaft 112. This bent end forms a stub which is engageable with arcular slot 117 formed in support member 83, as illustrated in FIG. 16. Foot lever 85 is rotatably mounted to shaft 112 on the opposite side of support member 83. Spring 111 is mounted similar to spring 110, however is disposed between support member 83 and foot lever 85. A left hand wound coil clutch spring 113 is disposed around shaft 112 FIG. 15 and secured by screw 116 to foot lever 85. The opposite end of coil clutch spring 113 is bent as is spring 114 so as to engage arcular slot 118. Arcuate slot 118 is formed into support member 83 as shown in FIG. 15.

The operation of the power driven cleated spool 55' will now be described. Foot lever 84 is depressed by the foot of an operator which causes the cleated spool 55' to rotate counter clockwise, toward the operator, which forces the power spade to move in the same direction. When foot lever 84 is released it rotates clockwise, the stub end 119 engages the end of the slot and releases clutch spring 114 on shaft 112. Coil clutch spring 114 engages shaft 112 after first rotating, such that end 119 displaces from end of slot 117, thereby locking shaft 112. When foot lever 84 is released, spring 110 urges foot lever 84 to return to its original position and disengages spring 114. As shaft 112 begins rotating counter clockwise, the stub end 119 of coil clutch spring 114 disengages the end of slot 118. At this point, the spring maintains the frictional contact with shaft 112 and compells the shaft and cleated spool 55' to rotate counter clockwise in unison.

Foot lever 85 functions in the same manner as foot lever 84, however activation of foot lever 85 causes cleated spool 55' to move away from the operation and push the power spade in the same direction. This is accomplished because the coil clutch spring 113 is wound opposite and foot lever 85 is depressed and thereby rotated in the opposite direction.

The drag buckets 70 of the second preferred embodiment are best described in reference to FIG. 17. The drag buckets 70 are generally 'L' shaped having a sidearm 71 and a base 72. A lip 73 is coupled to the base, thereby forming a three sided drag bucket. The sidearm 72 is coupled to a standard double link chain 45' by bolting or other means such that the drag bucket extends vertically away from the chain 45'. The drag buckets 70 are formed such that the front of base 72 has a semi-sharp edge which is capable of being used as a cutter to loosen the soil from the bottom or side of the excavation, while dragging the loosened soil from the excavation. It should be noted that in operation a small amount of soil may fall back in the excavation, however, the continual dragging process rapidly and efficiently completes the excavation. The drag buckets 70 being 'L' shaped are mounted to the double link chain 45' such that every other drag bucket is fastened to an opposite side of the chain 45' thereby eliminating eccentric torque to the chain which would occur if all drag buckets were mounted to one side of the chain. Mounting of the drag buckets in this fashion is best illustrated. In reference to FIG. 13. In the second embodiment, the side cutters 46' are rotatably fastened to the lower sprocket 22' in much the same manner as in the preferred embodiment. The side cutters 46' will rotate as the bottom sprocket 22' rotates. In the second embodiment, the chain 45' rotates clockwise and hence the side cutters rotate clockwise increasing the efficiency of the power spade.

An adjustable locking brake 75 is provided to lock the bracing lever assembly 50 into any desired position and thereby permit the entire weight of the power spade to be carried by the bracing lever assembly. The locking mechansim 75 will now be described in reference to FIGS. 12 and 13. One of the bracing levers is rigidly coupled to a circular brake drum 80 which is mounted about the pivot point 51'. Thus, when bracing lever 59' rotates, so does circular brake drum 80. Brake 81 formed from a braking material is fastened around brake drum 80. End 160 of brake 81 is rigidly fastened to the main frame while end 161 is mounted to rotating lever 77. Rotating lever 77 is rotably mounted to frame 20' about point 165, having end 166 and 167. Coil spring 78 is disposed between point 170 on the main frame and point 171 of brake drum 80, and lever 50' urges brake drum 80 to rotate counter clockwise. Spring 79 is secured between end 166 and point 168 on the main frame 20'. Spring 79 is coiled so as to urge end 167 downward and thereby tighten and lock brake band 81 on brake drum 80. End 167 is coupled to spring loaded cable 76 which extends along the main frame 20' and up the handle 23' so as to be able to be grasped by the hand of the operator. When the cable 76 is grasped by the hand of the operator, spring 79 is stretched releasing brake band 81 and permitting bracing lever 77 to rotate about pivot point 165 which releases and enables drum 80 to rotate. Spring 78 will now help lever 50' rotate down as the power spade is lifted. When the cable is held in this position, the position of the bracing lever can be adjusted to the desired angle. When cable 76 is released, spring 79 urges brake 81 back into the original locked position to prevent the brake drum 80 from rotating. By using this procedure, bracing lever assembly 50' can be locked into any digging position. The bracing lever will rotate about point 51' through approximately a 90° angle and will permit an operator to dig a very shallow excavation or a very deep post hole, or anything in between.

In this embodiment a different assembly is provided for movement of the power spade during operation. In addition, the assembly provides the capacity to transmit the excavating kick loads originating from the side cutters 46' and drag buckets 70 back into the ground, through the bracing lever assembly 50' and cleated spool 55'. The bracing levers 59' are pivoted to the main frame about point 51' as in the presently preferred embodiment. However, an adjustable locking brake 75 is provided to lock the bracing lever assembly 50 into any desired position and thereby permit the entire weight of the power spade to be carried by the bracing lever assembly.

The bracing lever assembly 50' in this embodiment is comprised of a pair of bracing levers 59', a push-pull rod 82 and support arm 83. The bracing levers 59' are disposed as previously described. One end of push-pull rod 82 is rotably secured to main frame 20' at point 180. The opposite end is pivotaly secured to the upper end of support arm 83 as shown in FIG. 12. Support arm 83 is mounted between push-pull rod 82 and the shaft 112 of the cleated spool 55'. Since the push-pull rod 82 arm 83 and levers 84 and 85 are all rotatably mounted on shaft 112 they will remain in the same relative position to the ground regardless of the angular position of the bracing levers 59'. In this position, parallel the ground, the push-pull rod is capable of efficiently transmitting the heavy kick loads to the ground while providing a stationary mounting for the shaft 112 of the cleated spool 55'.

In an alternate embodiment a reversing gear may be employed with the motor 26 which will enable the operator to alter the direction of rotation of the endless conveyor. Thus by utilizing the combination of the cleated sprocket of the second preferred embodiment and the reversing gear the power spade can be propelled or operated either forward or backward.

There has been described herein, a one man operated power spade which is adaptable for use in many excavation chores where heretofore had to be accomplished by manual methods. However, while the preferred and alternate embodiments of the present invention have been described in detail herein, it will be understood by those skilled in the art that various changes in form and detail may be made therein without departing from the spirit and scope of the invention.

I claim:

1. A portable power digging tool for use in excavating post holes, small trenches, and general digging, by a single operator, said portable power digging tool comprising;

a. an upright frame about which an endless conveyor is carried;

b. a plurality of buckets propelled by said endless conveyor for cutting and carrying soil;

c. emptying means for causing soil carried by said buckets to be ejected therefrom;

d. bracing means pivotly mounted to said frame for carrying loads resulting from excavation and for transmitting said loads back into the ground;

e. motor means for driving said endless conveyor;

f. propelling means comprising a foot pad rotatably mounted on a cleated spool, said cleated spool being secured to said bracing means; whereby a single operator can excavate post holes, small trenches, and perform general digging by grasping said frame, by placing a foot on said bracing means and activating said motor means causing said endless conveyor to rotate, said buckets cut and carry soil until engaging said emptying means at which point soil is ejected from said buckets.

2. A portable power digging tool for use in excavating post holes, small trenches, and general digging by a single operator, said portable power digging tool comprising;

a. an upright frame about which an endless conveyor is carried;

b. a plurality of buckets propelled by said endless conveyor for cutting and carrying soil;

c. emptying means for causing soil carried by said buckets to be ejected therefrom;

d. bracing means pivotly mounted to said frame for carrying loads resulting from excavation and for transmitting said loads back into the ground;

e. motor means for driving said endless conveyor;

f. propelling means comprising a foot pad having an adjustable stirrup for securing a foot thereto, a cleated spool rotatably mounted on a split shaft, said split shaft formed from a first and a second co-axial member, said first co-axial member capable of rotating independently of said second co-axial member, said first member of said split shaft rigidly coupled to said foot pad, the said second member of said split shaft being rotatably coupled to said cleated spool and rigidly coupled to said bracing lever;

a first spring means coiled around said first co-axial member of said split shaft one end of said first spring means coupled to said cleated spool and having one end secured to said cleated spool thereby causing said cleated spool to rotate as said foot pad is pushed down by the heel of said operator;

a second spring means coiled opposite said first spring means around said second co-axial member of said split shaft, one end of said second spring means coupled to said cleated spool, said second co-axial member capable of freely rotating in relation to said second co-axial member;

whereby a single operator can excavate post holes, small trenches, and perform general digging by grasping said frame, by placing a foot on said bracing means and activating said motor means causing said endless conveyor to rotate, said buckets cut and carry soil until engaging said emptying means at which point soil is ejected from said buckets.

3. A portable power digging tool for use in excavating post holes, small trenches, and general digging, by a single operator, said portable power digging tool comprising;

a. an upright frame about which an endless conveyor is carried;

b. a plurality of buckets propelled by said endless conveyor for cutting and carrying soil;

c. emptying means for causing soil carried by said buckets to be ejected therefrom;

d. bracing means pivotly mounted to said frame for carrying loads resulting from excavation and for transmitting said loads back into the ground;

e. motor means for driving said endless conveyor;

f. propelling means comprising; a cleated spool rigidly mounted on a shaft, said shaft rotatably mounted to said bracing means, and said bracing means having a restraining means disposed on said shaft;

a first lever means rotatably mounted on said shaft having a clockwise wound spring disposed on said shaft and coupled to said first lever means, said clockwise wound spring having an end capable of engaging said restraining means such that a rotation of said first lever means in a clockwise direction causes said shaft to rotate while rotation of said first lever means in a counter-clockwise direction causes said end of said coil spring to engage said restraining means and rotate freely on said shaft;

a second lever means rotatably mounted on said shaft having a counter-clockwise wound spring disposed on said shaft and coupled to said second lever means, said counter-clockwise wound spring having an end capable of engaging said restraining means such that a rotation of said second lever means in a counter-clockwise direction causes said shaft to rotate while rotation of said second lever means in a clockwise direction causes said end of said coil spring to engage said restraining means and rotate freely on said shaft;

a first spring means coupled to said restraining means and said first lever means for causing said first lever means to return to its original position after being rotated;

a second spring means coupled to said restraining means and said second lever means for causing said second lever means to return to its original position after being rotated;

whereby a single operator can excavate posts holes, small trenches, and perform general digging by grasping said frame, by placing a foot on said bracing means and activating said motor means causing said endless conveyor to rotate, said buckets cut and carry soil until engaging said emptying means at which point soil is ejected from said buckets.

4. A portable power digging tool for use in excavating post holes, small trenches and for general digging by a single operator, said portable power digging tool comprising:

a. an upright frame about which an endless conveyor is carried, said frame having a sprocket means mounted on both ends for permitting said endless conveyor to revolve therearound, one end of said frame having a cutting means mounted on said sprocket means for cutting and scraping soil, said cutting means formed so as to excavate a hole larger than said frame and thereby permit said portable power digging tool to be lowered into said hole as the excavation continues;

b. a plurality of buckets propelled by said endless conveyor for cutting and carrying soil, said buckets being formed with rigid sides and a separate bottom, said sides being rigidly mounted to said endless conveyor, said bottom being rotatably mounted to said endless conveyor such that as said buckets approach the upper sprocket a portion of said bucket engages a roller means disposed on said upper sprocket forcing said bottom to rotate and force any soil therefrom;

c. bracing means pivotly mounted to said frame for carrying loads resulting from excavation and for transmitting said loads back into the ground;

d. manual propelling means coupled to said bracing means for driving said power spade, said propelling means comprising:

1. a foot pad having an adjustable stirrup for securing a foot thereto;

2. a cleated spool rotatably mounted on a split shaft, said split shaft formed from a first and a second co-axial member, said first co-axial member capable of rotating independently of said second co-axial member, said first member of said split shaft rigidly coupled to said foot pad, the said second member of said split shaft being rotatably coupled to said cleated spool and rigidly coupled to said bracing lever;

3. a first spring means coiled around said first co-axial member of said split shaft, said first co-axial member having one end of said first spring means coupled to said cleated spool and having one end secured to said cleated spool thereby causing said cleated spool to rotate as said foot pad is pushed down by the heel of said operator;

4. a second spring means coiled opposite said first spring means around said second co-axial member of said split shaft, one end of said second spring means coupled to said cleated spool, said second co-axial member capable of freely rotating in relation to said second coaxial member;

e. motor means for driving said endless conveyor;

whereby a single operator can excavate post holes, small trenches and perform general digging by grasping said frame, by placing a foot on said bracing means and activating said motor means causing said endless conveyor to rotate, said buckets cut and carry soil until engaging said emptying means at which point soil is ejected from said buckets.

* * * * *